US009555940B2

(12) United States Patent
Ogawa et al.

(10) Patent No.: US 9,555,940 B2
(45) Date of Patent: Jan. 31, 2017

(54) CAP FOR VIAL

(71) Applicant: Taisei Kako Co., Ltd., Osaka (JP)

(72) Inventors: Yukihiro Ogawa, Osaka (JP); Satoshi Miyatake, Osaka (JP)

(73) Assignee: Taisei Kako Co., Ltd., Osaka (JP)

( * ) Notice: Subject to any disclaimer, the term of this patent is extended or adjusted under 35 U.S.C. 154(b) by 0 days.

(21) Appl. No.: 14/914,819

(22) PCT Filed: Jul. 1, 2014

(86) PCT No.: PCT/JP2014/067504

§ 371 (c)(1),
(2) Date: Feb. 26, 2016

(87) PCT Pub. No.: WO2015/029580

PCT Pub. Date: Mar. 5, 2015

(65) Prior Publication Data

US 2016/0200489 A1 Jul. 14, 2016

(30) Foreign Application Priority Data

Sep. 2, 2013 (JP) ..... 2013-180913

(51) Int. Cl.
*B65D 41/58* (2006.01)
*B65D 41/62* (2006.01)
(Continued)

(52) U.S. Cl.
CPC ..... *B65D 51/002* (2013.01); *A61J 1/05* (2013.01); *A61J 1/1425* (2015.05)

(58) Field of Classification Search
CPC ..... B65D 51/002; A61J 1/1425; A61J 1/05
(Continued)

(56) References Cited

U.S. PATENT DOCUMENTS 3,587,897 A * 6/1971 Rohde ..... B65D 51/002 215/249
4,205,754 A * 6/1980 Nielsen ..... B65D 51/002 215/249
(Continued)

FOREIGN PATENT DOCUMENTS

JP 04-267761 A 9/1992
JP 08-085565 A 4/1996
(Continued)

OTHER PUBLICATIONS

International Search Report dated Sep. 30, 2014.

*Primary Examiner* — J. Gregory Pickett
*Assistant Examiner* — Niki M Eloshway
(74) *Attorney, Agent, or Firm* — Wood, Phillips, Katz, Clark & Mortimer

(57) ABSTRACT

There is provided a snap-on vial cap with a protective cover, which can be removed from a cap body by a constant removal force, and can hardly be attached to the cap body again, once being removed. A cap body 5 and a protective cover 6 are molded integrally by an insert molding method or a two-color-molding method, which generates moderate adhesive strength therebetween. An annular convex portion 12, 13 having a concave section 14 formed on the outer circumferential surface thereof is provided on the cap body 5, and an engagement portion 18 for engaging with the concave section 14 is provided on the protective cover 6, thereby enabling the protective cover 6 to be easily removed from the cap body 5 with good operativity while preventing the protective cover 6 from accidentally detaching. Alternatively, projections 23 provided on a top plate of the cap body 5 are engaged into a plug 4 to prevent the cap 1 from rotating.

12 Claims, 14 Drawing Sheets

(51) Int. Cl.
*B65D 51/00* (2006.01)
*A61J 1/05* (2006.01)
*B65D 39/00* (2006.01)

(58) Field of Classification Search
USPC ..... 215/232, 249
See application file for complete search history.

(56) References Cited

U.S. PATENT DOCUMENTS 4,227,617 A * 10/1980 Albrecht ..... B65D 51/002 215/249
4,471,879 A * 9/1984 Connor ..... B65D 51/002 215/249
5,421,469 A * 6/1995 Lee ..... B65D 55/0872 215/247
6,042,770 A 3/2000 Sudo et al.
8,777,031 B2 * 7/2014 Aneas ..... B65D 45/322 215/249
2006/0231519 A1 * 10/2006 Py ..... B65D 51/002 215/342
2008/0000870 A1 1/2008 Alvarez et al.
2010/0050575 A1 * 3/2010 Aneas ..... B65D 41/28 53/485
2010/0089862 A1 4/2010 Schmitt
2011/0266249 A1 * 11/2011 Kakutani ..... B65D 51/002 215/364
2012/0160850 A1 6/2012 Gelibert et al.
2014/0209603 A1 * 7/2014 Aneas ..... A61J 1/18 220/257.1

FOREIGN PATENT DOCUMENTS

JP 8-299412 11/1996
JP 11-292126 A 10/1999
JP 2011-093586 A 5/2011
JP 2012-106763 A 6/2012
WO 94/04424 A1 3/1994
WO 2013/034594 A1 3/2013

* cited by examiner

CAP FOR VIAL

TECHNICAL FIELD

The present invention relates to a vial cap.

BACKGROUND ART

It is common practice in the medicinal industry to store a medicine, such as a drug solution, in a vial under a sealed condition till the time of administration to patients. Where it is required that the guaranteed shelf life of the drug solution should be prolonged, the drug solution is freeze-dried within a vial, and the thus obtained freeze-dried formulation is stored in the sealed vial, and then returned to a liquid state by adding a diluent or a solvent at the time of administration to a patient. The drug solution may be stored in a vial without being freeze-dried. A solid drug, such as powder produced in advance, may also be stored in a vial. Hereinafter, a drug solution, freeze-dried formulation, a solid drug, and the like are generally called drugs.

The common vial available in the market has a closed-end cylindrical body (barrel) for containing a drug, and a contracted mouth to define an upper opening of the body, wherein a radially projected flange is formed on the outer periphery of the upper end of the mouth. A rubber stopper is fitted into the mouth of the vial to seal the drug therein, and then this rubber stopper is fixed onto the flange of the vial with a thin aluminum cap wound tightly thereon to ensure that the rubber stopper will not be removed till the time of administration of the drug.

However, some problems are inherent in the use of the aluminum cap. One of them is that the sharp edge generated in removing the cap may possibly damage the latex gloves worn by health care professionals. The other is that, when the aluminum cap is torn, metal particles may be caused and mixed into the drug. Also, the separation of combustibles from incombustibles is required for disposal from a view point of environmental protection in recent years, however, it is practically difficult to sort out only aluminum caps for disposal on the medical treatment front.

In order to solve these problems, the applicant of the present invention has developed plastic snap-on caps for vials heretofore and, for example, discloses the following Patent Literature 1 and 2.

These snap-on caps each have a cylindrical cap body and a protective cover, made each of a synthetic resin, the cap body attached to surround a mouth of a vial and provided with a through hole in the central part thereof, and the protective cover attached to the upper surface of the cap body to close the through hole for preventing a rubber stopper from being contaminated via the through hole during storage. The protective cover is formed, separately from the cap body, and is attached to the cap body.

CITATION LIST

Patent Literature

Patent Literature 1: Japanese Patent Laid-Open No. Hei11-292126

Patent Literature 2: Japanese Patent Laid Open No. Hei8-299412

SUMMARY OF INVENTION

Technical Problem

In the snap-on cap described in Patent Literature 1, a protective cover is fitted onto a cap body after their respective forming. Therefore, it is possible to remove the protective cover from the cap body in storage and to easily re-attach it to the cap body later, and thus it cannot be assured that the rubber stopper will not be contaminated till the time of administration to a patient.

On the other hand, in the snap-on cap described in Patent Literature 2, a protective cover and a cap body are formed by different materials, individually, and the protective cover is fixed on the upper surface of the cap body by ultrasonic welding, and thus, once the protective cover has been removed from the cap body, it may not be fixed thereon again. However, due to various factors, such as unevenness of molding accuracy and output change of an ultrasonic welding unit in operating time course, welding strength has not be stabilized, and thus, troubles have been caused, for example, adhesive strength was so strong that a protective cover may not be removed from a cap body, while on the other hand, adhesive strength was so weak that a protective cover may be detached accidentally.

Therefore, it is an object of the present invention to provide a snap-on vial cap with a protective cover, which can be removed from a cap body by a constant removal force, and can hardly be attached to the cap body again, once being removed.

Solution to Problem

In order to solve the above-mentioned subject, the following technical measure has been taken by the present invention.

According to the present invention, a vial, cap includes: a synthetic resin cap body having an upper surface and a synthetic resin protective cover; wherein the cap body is fitted onto a mouth of a vial and is provided with a through hole vertically penetrated in the central part thereof, and wherein the protective cover is removably attached to the upper surface of the cap body to close the through hole. Further, an adhesive strength is generated between mutual contacting surfaces of the cap body and the protective cover by injection-molding either one of the cap body and the protective cover making the contacting surface of the other, preliminarily formed by an injection molding method and inserted in an injection mold for forming the one, serve as a shaping surface for forming the contacting surface of the one.

It is preferred that a cap body is first formed by an injection molding method, and the cap body is inserted in an injection mold for forming a protective cover, and, in turn, the protective cover is formed onto the upper surface of the cap body by an injection molding method. The cap of the present invention may be formed by an insert molding method of injection molding a protective cover on a cap body which has been cooled, that is, the protective cover may be formed by a two-color-molding method of injection molding the protective cover without a mold release process of the cap body. Further, it is preferred that a cap body and a protective cover are formed by different materials from each other, for example, thermoplastic synthetic resin materials, such as polypropylene and high density polyethylene, may be used as a molding material of the cap body, thermoplastic synthetic resin materials, such as polystyrene and straight-chain-shape low density polyethylene, may be used as a molding material of the protective cover. It is preferred that the molding material of the protective cover, secondarily formed, preferably has a melting point lower than that of the molding material of the cap body. It is also preferred that the material of the protective cover is more flexible than that of the cap body. Various molding conditions and materials are adjusted to set the adhesive strength generated between the contact surfaces of the cap body and the protective cover to the level that the protective cover can be released from the cap body easily by pushing up the protective cover from the cap body with a finger.

Since a cap body and a protective cover are molded integrally by an insert molding method or a two-color-molding method, according to the vial cap of the present invention, it is not necessary to make the protective cover or the cap body into the structure or the shape such that the protective cover can be attached and fixed to the can body after molding. Adhesive strength between the contact surfaces of the cap body and the protective cover generated at the time of molding will disappear, once the protective cover is separated from the cap body. This adhesive strength can be easily stabilized by constantly controlling the various injection conditions at the time of injection molding. Therefore, the protective cover can be removed from the cap body by the stable removal force, and the protective cover cannot be attached to the cap body as in the same way as in the initial state once being removed, and thus, the fact that the protective cover is normally attached to the cap body can ensure that the plug fitted into the mouth of the vial is not contaminated, and also alteration of the content can be prevented.

In the vial cap of the above-mentioned present invention, the cap body includes an annular convex portion with a radially concave portion, the convex portion projected upward from the upper surface of the cap body and positioned in the periphery of the through hole, the concave portion formed on an outer circumferential surface or an inner circumferential surface of the convex portion, and wherein the protective cover may be provided with an engagement portion to fill the concave portion. According to this arrangement, the engagement portion of the protective cover fits into the concave portion of the cap body, so that the engagement portion of the protective cover is physically engaged with the concave portion of the cap body vertically, and thus, the bonding strength of the protective cover and the cap body can be more stabilized. On the other hand, if the periphery of the protective cover is pushed up with a finger by the specified force, the engagement portion and the concave portion are disengaged due to the flexibility of the protective cover and/or the cap body, the protective cover is detached with a snap from the cap body. Therefore, since this greatly excels in usability, even though a medical staff needs to remove protective covers of several tens of vials every day, one can work promptly in a medical setting without hurting one's fingertip. The above-mentioned annular convex portion may be formed only by a ridge circumferentially extended, or may be formed only by plural claw parts allocated circumferentially spaced apart, or may be formed by a combination of the ridge and the claw part, mentioned above. Alternatively, the above-mentioned concave portion may be a circumferentially continuous groove, or may be formed by plural holes allocated, circumferentially spaced apart, or the above-mentioned groove may be formed and further plural holes may be also formed circumferentially spaced apart at the bottom of this groove. When a concave portion is formed by the above-mentioned holes, the above-mentioned engagement portion to fill these holes is formed into a claw shape.

Preferably, the upper surface of the cap body is in surface-contact with the undersurface of the protective cover, and the contact surface of this cap body is positioned in the periphery of the above-mentioned annular convex portion. According to this arrangement, even though the undersurface of the protective cover comes into contact with the upper surface of the cap body again after removal of the protective cover from the cap body, they cannot be in perfect contact in the same way as immediately after molding, and a small gap generates between the protective cover and the cap body. The presence of this gap make it increasingly difficult to re-engage the engagement portion with the concave portion, so that the protective cover, which was once removed, can be more securely prevented from being again attached to the cap body.

The above-mentioned annular convex portion can be provided with a circumferentially continuous ridge. This ridge may range over the whole circumference, or may be cut off at a part of the ridge. In this case, since the engagement portion may fit into the concave portion in a wide range of the circumference, a good operativity can be obtained even if the depth of the above-mentioned concave portion is very shallow.

The above-mentioned annular convex portion may be provided with plural claw parts allocated circumferentially spaced apart. Each claw part preferably has an upper-limit side inclined radially outward, and the concave portion is formed on the outer circumferential surface of this claw part. According to this arrangement, the plural claw parts projected upward are provided circumferentially spaced apart. Therefore, even though the projection height of the claw parts and the depth of the concave portion are relatively increased, the protective cover can be removed from the cap body, and re-fitting of the protective cover into the cap body can be securely prevented by projected and inclined claw parts. As for each claw part, its upper-limit side may be radially inclined inward, and the above-mentioned concave portion may be formed on the inner circumferential surface of this claw part. The annular convex portion may be formed with both of the ridge and the claw part as above, or the annular convex portion may be formed by either thereof.

The concave portion is more preferably formed on the outer circumferential surface of the convex portion, the protective cover is provided with a flange extended radially outward from the engagement portion, and space as a fingerplate is formed in at least part of the circumferential direction under the outer periphery of this flange. According to this arrangement, when a finger is hooked on the underside of the outer periphery of the flange to raise it, the protective cover deforms so as to remove the engagement portion from the concave portion due to flexibility of the protective cover, and thus, the protective cover can be removed with better operativity.

A reinforcement rim portion positioned above the above-mentioned annular convex portion can be provided on the upper surface of the protective cover. According to this arrangement, the protective cover can be prevented from bending on the region into which an annular convex portion fits.

The protective cover may include a boss portion fitted into the through hole. According to this arrangement, the through hole can be more securely sealed, and the presence of this boss portion makes it much more difficult to re-fit the engagement portion into the concave portion. The boss portion can be made into the truncated cone shape whose diameter is reduced as it goes below, and the through hole can be made into a trumpet shape which spreads upward.

The above-mentioned annular convex portion can be provided along the periphery of the through hole.

The cap body may include a top plate for pressing down a plug which is fitted into the mouth of the vial, and a cylindrical portion which covers the outer periphery of the mouth of the vial. The through hole and the annular convex portion can be provided on the top plate. Snap portions may be provided on the inner circumferential surface of the cylinder to be engaged vertically with the mouth of the vial, and a slit extended vertically can be formed in at least part of the circumferential direction.

In this case, the protective cover preferably further includes a connecting piece to fill the slit, deformation of the cylinder such that the slit is widened can be prevented by the connecting piece. On the other hand, if the connecting piece is removed from the cylinder, the cylinder deforms to widen the slit, and release the engagement between the snap portions and the mouth, which enables removal of the cap body from the vial mouth. According to this arrangement, by removing the protective cover, the cap body snapped onto the mouth can be easily removed from the vial, and thus separate disposal of the vial, the cap body, and the vial plug can also be easily conducted.

In the above-mentioned vial cap of the present invention, the cap body has a top plate, wherein the upper surface of this top plate is the contact surface against the protective cover, the through hole is provided in the central part of the top plate, and at least one anti-rotation projection, dug into the upper surface of the plug fitted into the mouth of the vial, is provided on the undersurface of the top plate. The plug is preferably made from elastomer. According to this arrangement, when the cap of the present invention is placed over the vial mouth with the plug fitted thereinto, the anti-rotation projection of the cap body is engaged into the plug to prevent the cap from relatively rotating about the vial, so that the airtightness between the cap and the plug can be prevented from being broken by relative rotation.

It is preferred that the plural anti-rotation projections are allocated circumferentially spaced apart. According to this arrangement, the above-mentioned relative rotation can be prevented more securely.

It is preferred that the anti-rotation projections are provided, at positions vertically opposing to the upper surface of the mouth of the vial. According to this arrangement, since the plug is put between the upper surface of the mouth and the above-mentioned projections, deformation of the plug to be curved downward can be prevented, and thus, the seal of the vial mouth can be prevented from being broken by large deformation of the plug.

It is preferred that an annular rib in airtight contact with the upper surface of the plug is provided on the undersurface of the top plate. This annular rib is positioned in the periphery of the through hole. According to this arrangement, since the annular rib and the plug are in airtight contact with each other, the central part of the upper surface of the plug is isolated from the open air, and thus, this central part can be prevented from being contaminated.

Preferably, the above-mentioned annular rib is formed so as to pass between the periphery of the through hole and the anti-rotation projections. According to this arrangement, the annular rib can be brought into contact with the upper surface of the plug radially inwardly than the portion deformed locally by engagement with the above-mentioned projections.

A recess hollowed upward is formed on the undersurface of the top plate in a region between the above-mentioned, annular rib and the periphery of the top plate, so that the plate thickness of the top plate in the region, where the recess is formed, is thinner than that of the periphery of the top plate. According to this arrangement, the region, where the concave portion is formed, of the top plate, is thinned so that sink marks can be avoided from being generated on the upper surface of the top plate by resin cooling after injection molding. Since relatively large thickness is ensured for the periphery of the top plate, a mold can be placed on a position on the outer periphery of the top plate and also under the periphery of the protective cover at the time of injection molding of the above-mentioned protective cover, and further the relatively large thickness of this mold can also be ensured, which leads to increased strength of the mold, and thus, a cavity part for fingerplates can be formed under the periphery of the protective cover after molding.

Advantageous Effects of Invention

According to the present invention, there is provided a snap-on vial cap with a protective cover, which can be removed from a cap body by a constant removal force, and can hardly be attached to the cap body again, once being removed.

DESCRIPTION OF EMBODIMENTS

Figure 1:
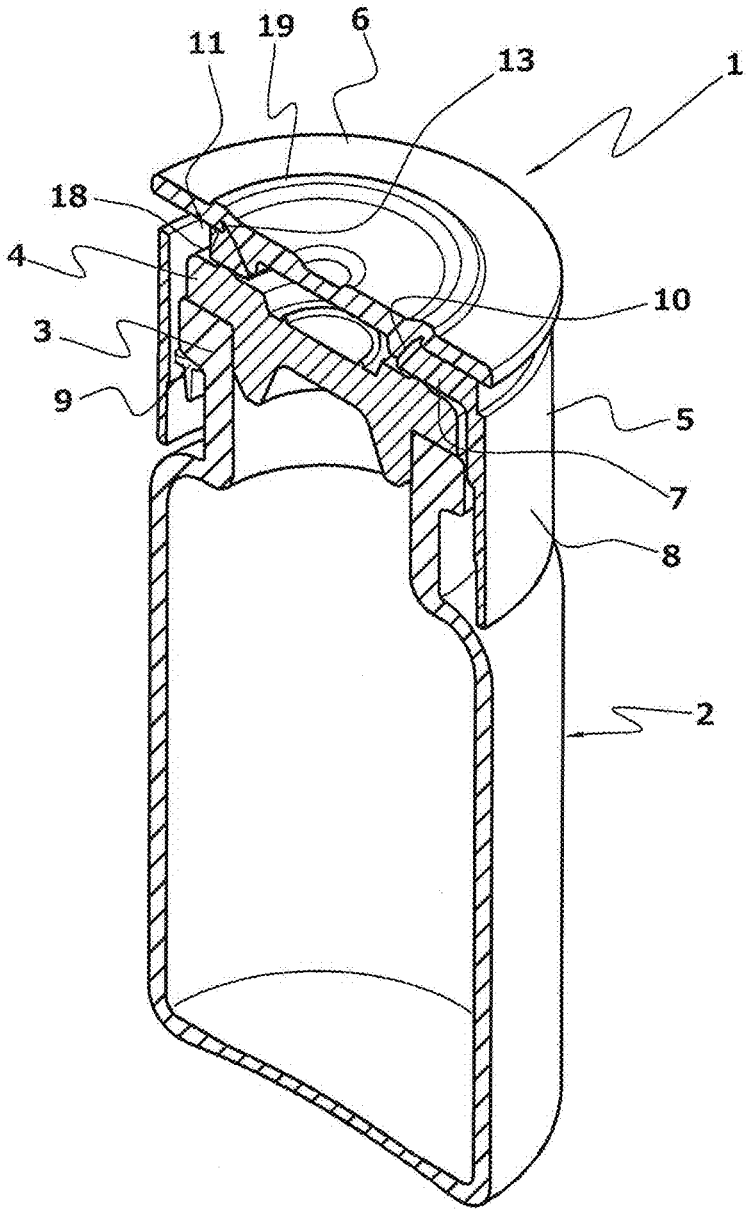
FIG. 1 is a longitudinal cross-sectional perspective view in general showing a snap-on vial cap fitted on a vial, according to a first embodiment of the present invention.
Figure 2:
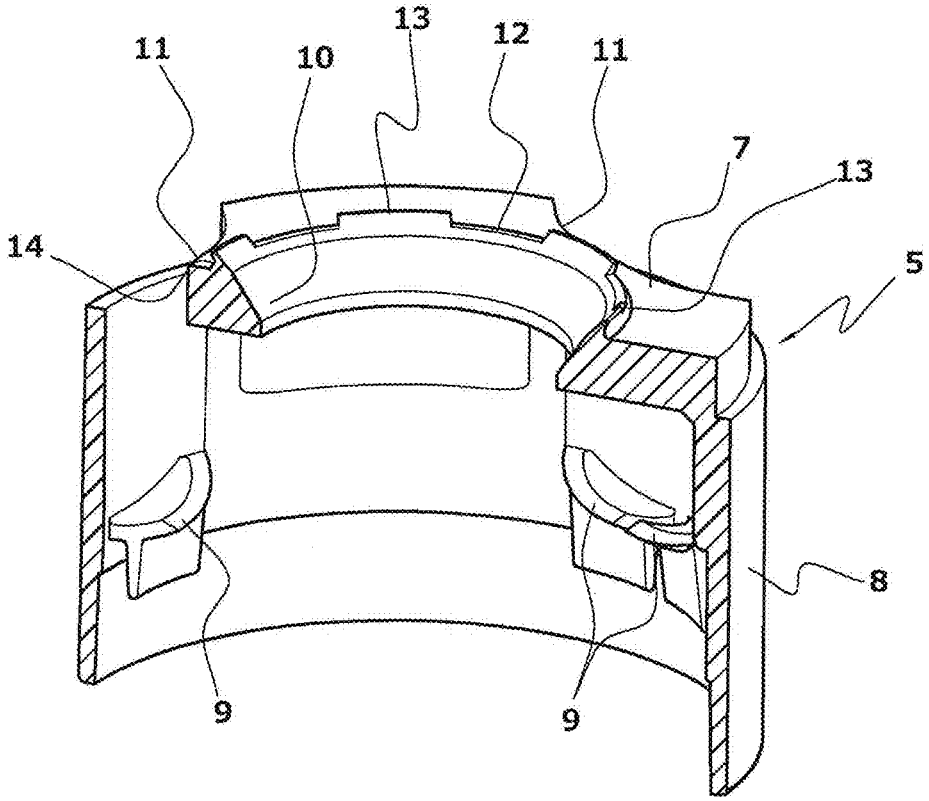
FIG. 2 is a longitudinal cross-sectional enlarged perspective view of a cap body of the cap.
Figure 3:
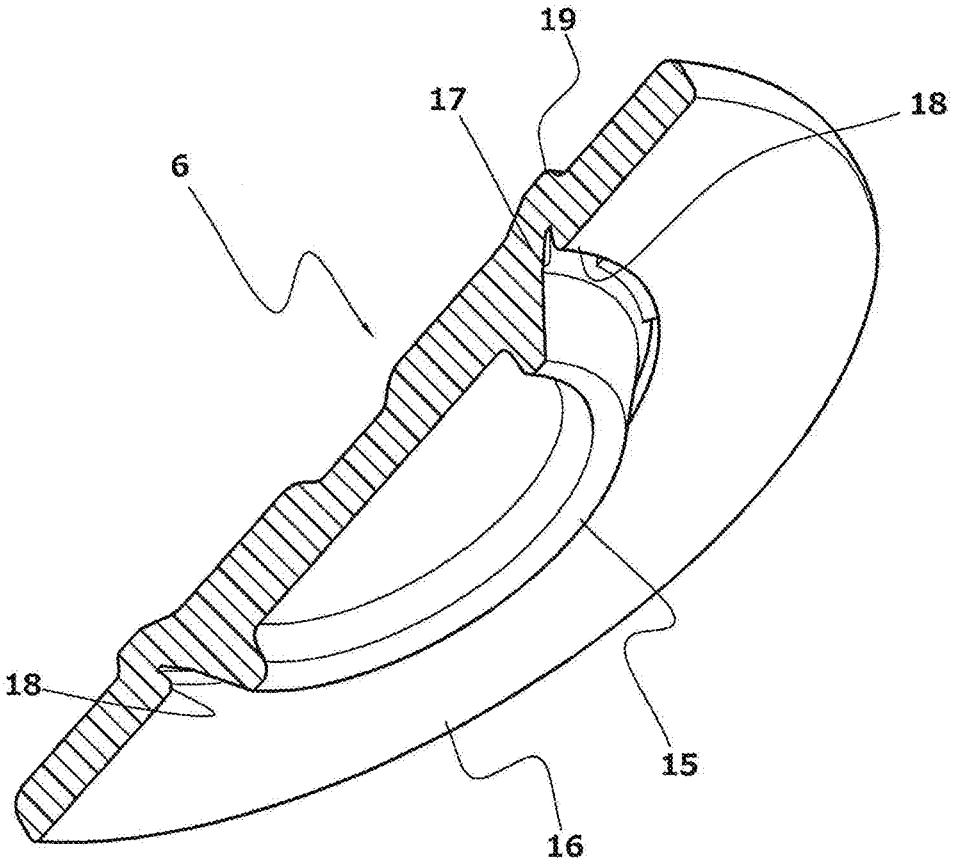
FIG. 3 is a longitudinal cross-sectional enlarged perspective view of a protective cover of the cap.
Figure 4:
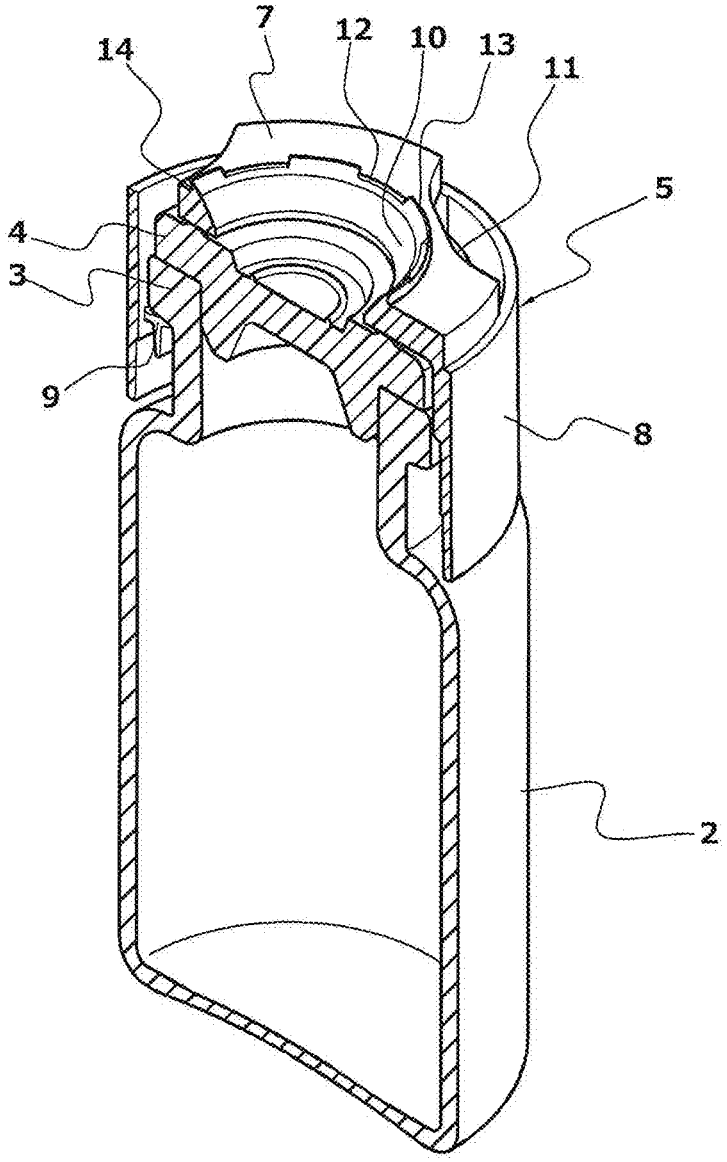
FIG. 4 is a longitudinal cross-sectional perspective view showing the cap with the protective cover removed.

Hereinafter, the suitable embodiments of the present invention are described based on drawings.

Embodiments

FIGS. 1 to 4 show a snap-on vial cap 1 according to a first embodiment of the present invention. This cap 1 is attached with a snap by pressing in from above toward a mouth 3 of a vial 2, which prevents a plug 4 made from elastomer, such as butyl rubber, fitted into the mouth 3, from being removed from the mouth 3, wherein a central part of the upper surface of the plug 4, through which an injection needle runs, is covered, so that fine floating particles, such as dust, are prevented from adhering.

The cap 1 is formed of a cap body 5, made of a thermoplastic synthetic resin material, and a protective cover 6, made of a thermoplastic synthetic resin material. The cap body 5 and the protective cover 6 are molded integrally by an insert molding method or a two-color-molding method, so that the protective cover 6 is removably attached to the upper surface of the cap body 5.

The cap body 5 is provided with a top plate 7 for pressing down the plug 4 fitted into the mouth 3 of the vial 2 from above, and a cylinder 8 fitted onto the mouth 3 of the vial 2 so as to cover an outer periphery of this mouth 3. Although the cylinder 8 is extended downward from the outer periphery of the top plate 7 in the illustrated example, the outer periphery of the top plate may be radially projected outward from the cylinder. Snap portions of plural elastic engagement pieces 9 are integrally molded on the inner circumferential surface of the cap body 5, and they pass through the flange of the mouth 3 by reducing their each diameter at the time of attachment to the mouth 3, but they prevent the cap body 5 from being removed from the mouth 3 by engagement with a lower end of the flange after attachment. According to the illustrated embodiment, three elastic engagement pieces 9 are allocated circumferentially spaced apart at equal intervals.

In axial central part of the top plate 7 of the cap body 5, a through hole 10 vertically penetrated is formed, wherein the diameter of this through hole 10 is equivalent to the diameter of the vial mouth 3. The inner circumferential surface of the through hole 10 is tapered where the upper-limit side is radially inclined outward. Further, a die-cut hole 11 is formed in an outer periphery of the top plate 7 above each elastic engagement piece 9. This die-cut hole 11 is formed by being released from a mold for injection molding the elastic engagement pieces 9. The upper surface of the top plate 7 is in contact with the undersurface of the protective cover 6 throughout.

An annular convex portion, positioned around the through hole 10 on the upper surface of the top plate 7 of the cap body 5 and projected upward, is integrally provided. In this embodiment, the annular convex portion includes a ridge 12 extending over the whole circumference along the inner periphery of the upper surface of the top plate 7, that is, the upper edge of the through hole 10, and plural claw portions 13 extended further upward from the upper limit of this ridge 12.

The inner circumferential surface of the ridge 12 is formed into a tapered surface where the upper-limit side is inclined radially outward, the inclination angle being slightly larger than that of the inner circumferential surface of the through hole 10. A concave portion 14 radially depressed inward is formed on the outer circumferential surface of the ridge 12. In this embodiment, this concave portion 14 is formed into a circumferentially extended groove having a circular-arcuate cross section wherein the depth of the depression of the concave portion 14 is less than 1 mm.

The plural claw portions 13 are allocated circumferentially spaced apart. The claw portions 13 each is further projected upward from the upper limit of the ridge 12, and also the upper-limit side of each claw portion 13 is radially inclined outward. The inner circumferential surface of this claw portion 13 is formed into a continuous surface with the inner circumferential surface of the ridge 12, while the outer circumferential surface of the claw portion 13 is formed into a continuous surface with the outer circumferential surface of the ridge 12. Therefore, the above-mentioned concave portion 14 is depressed radially inward more greatly on the outer circumferential surface of the claw portion 13 than in the region where the claw portion 13 does not exist. It is preferred that the claw portions 13 are provided circumferentially in at least three places, one place or two places, however, may be acceptable. A relatively large space is formed at the position, where the above-mentioned die-cut hole 11 is provided, under the protective cover 6. Therefore, if the upper position of the die-cut hole 11 is made into a fingerplate region for removal of the protective over 6, it becomes easy to hook a finger on the protective cover 6. In order to separate the protective cover 6 easily from the claw portion 13 when a finger is hooked on this fingerplate region to remove the protective cover 6, the claw portions 13 can also be provided at the position spaced apart circumferentially from the above-mentioned fingerplate region without claw portion 13 at the position corresponding to the above-mentioned fingerplate region.

The above-mentioned protective cover 6, removably attached to the upper surface of the cap body 5, is used to fill the through hole 10. This protective cover 6 includes a boss portion 15, having a truncated cone shape, fitted into the through hole 10 of the cap body 5, and a flange 16 extended radially outward from this boss portion 15, and is approximately formed into a disk in general. On the undersurface of the protective cover 6, a concave portion 17, into which the ridge 12 and the claw portion(s) 13 of the cap body 5 are fitted is formed circumferentially in the periphery of the boss portion 15. The region, which defines the outer periphery of this concave portion 17, is formed into an engagement portion 18, which engages with the above-mentioned groove 14 of the cap body 5 so as to fill the groove 14. The above-mentioned flange 16 is extended radially outward from the engagement portion 18, and the above-mentioned engagement portion 18 can preferably be formed by the inner periphery of the flange 16, as shown in the illustrated example. This engagement portion 18 is formed annularly over the whole circumference. In order to compensate the strength reduction of the protective cover 6 by presence of the concave portion 17, a reinforcement rim portion 19 having a ring shape is integrally molded on the upper surface of the protective cover 6 above the concave portion 17.

The protective cover 6 has a diameter larger than that of the top plate 7 of the cap body 5, thereby, space as a fingerplate is formed over the whole circumference under the outer periphery of the protective cover 6. The space as a fingerplate just exists in at least one part of the circumferential direction.

According to the cap 1 of this embodiment, the cap body 15 is molded by an injection molding method using an injection mold for the cap body, and then the cap body 15 is inserted in an injection mold for molding the protective cover 6, while the contact surface of the cap body 15 with the protective cover 6 (that is, the upper surface of the top plate, the inner circumferential surface of the through hole, and the surface of the annular convex portion, in this embodiment) is served as a shape-imparting surface for the undersurface of the protective cover 6, so that the protective cover 6 is formed by an injection molding method. By this molding method, between the contact surfaces of the cap body 15 and the protective cover 6, adhesive strength is generated sufficiently to release the protective cover 6 by pushing up the protective cover 6 with a fingertip.

The concave portion 14 of the annular convex portion of the cap body 5 is undercut at the time of injection molding of the cap body 5. However, since the depth of its depression is small, it can be released from the mold by a temporary elastic deformation of the annular convex portion. When the depth of the depression is relatively large, which makes it difficult to be released from a mold, it can also be undercut by using a slide mold or the like.

To generate moderate adhesive strength, the cap body 15 and the protective cover 6 are preferably formed by different materials from each other, for example, examples of molding materials for the cap body 15 include polypropylene and high density polyethylene, while examples of molding materials for the protective cover 6 include straight-chain low density polyethylene, and polystyrene.

According to the cap 1 of the present embodiment, an engagement structure is adopted such that the protective cover 6 cannot be substantially attached to the cap body 15 in the case where the cap body 15 and the protective cover 6 are molded individually. However, since the cap body 15 and the protective cover 6 are integrally molded by an insert molding method or a two-color-molding method, it can be securely assured that the protective cover 6 will not be removed till the time of administration to a patient. Further, by reduced adhesive strength between the cap body 15 and the protective cover 6, and the fitting force of the ridge 12 and the claw portion 13 with the engagement portion 18, the protective cover 8 can be prevented from being separated accidentally, and the protective cover 6 can be removed with a good operativity by pushing up the protective cover 6 with a finger.

The present invention is not limited to the above-mentioned embodiment, and the design can be varied properly.

Figure 5:
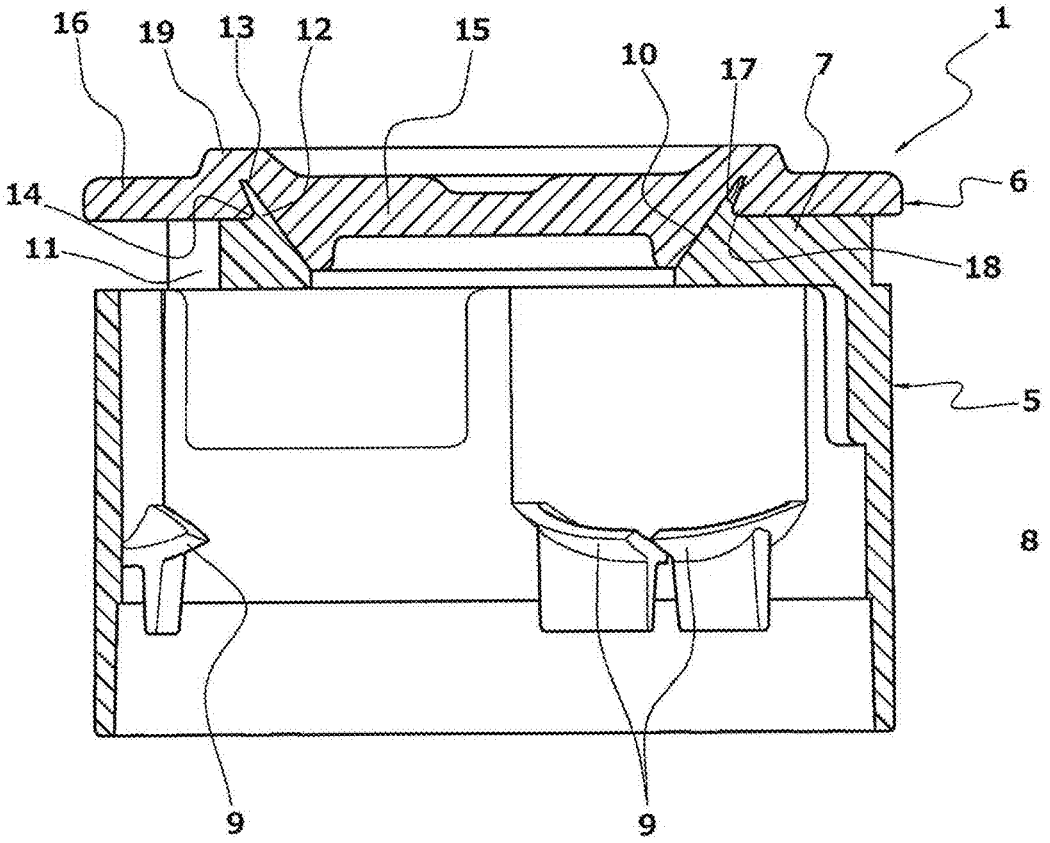
FIG. 5 is a longitudinal cross-sectional enlarged view showing a snap-on vial cap according to a second embodiment of the present invention.

For example, as shown in FIG. 5, the projection height of claw portions 13 may be further increased.

Figure 6:
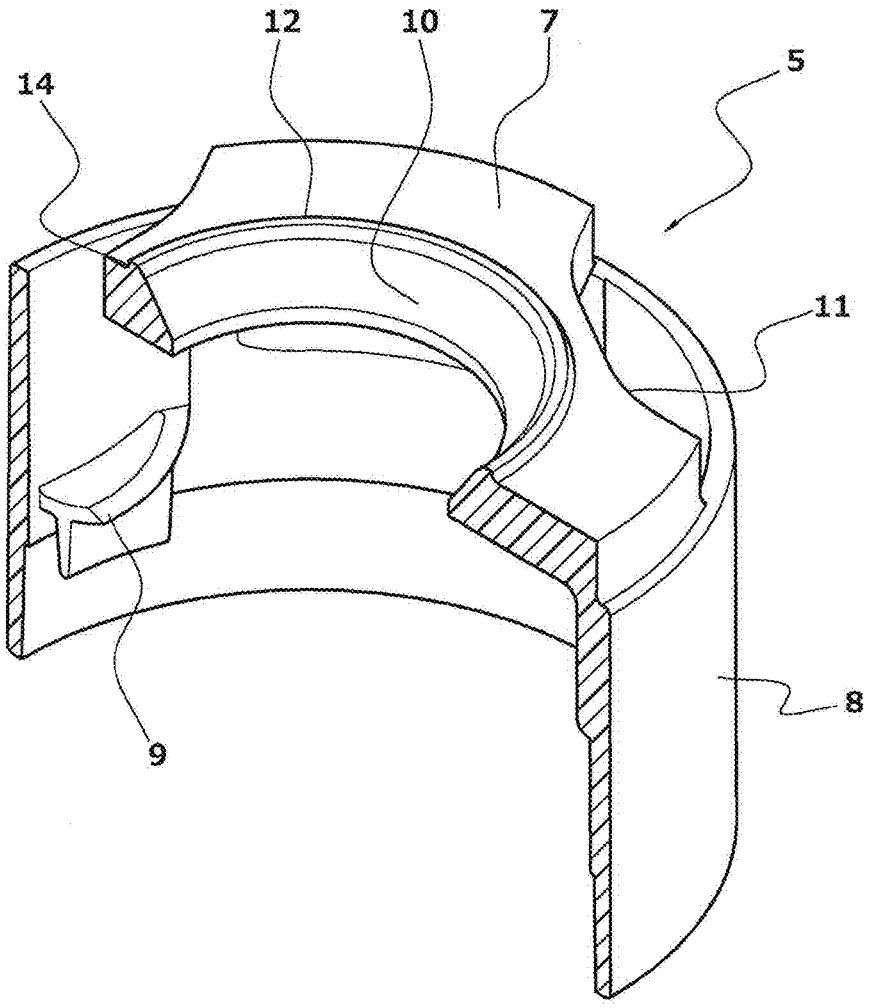
FIG. 6 is a longitudinal cross-sectional enlarged perspective view of the cap body of a snap-on vial cap according to a third embodiment of the present invention.

As shown in FIG. 6, an annular convex portion may be formed only by ridge 12 without a claw portion.

Figure 7:
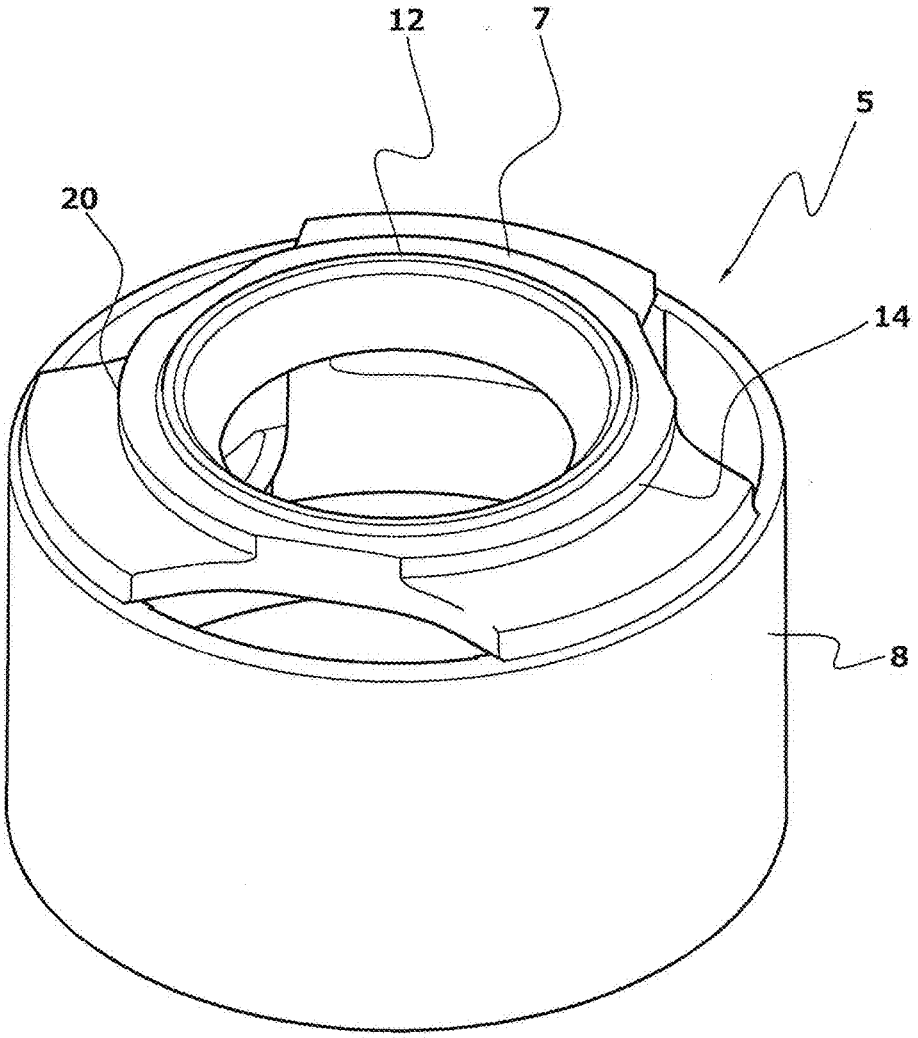
FIG. 7 is an enlarged perspective view of the cap body of a snap-on vial cap according to a fourth embodiment of the present invention.
Figure 8:
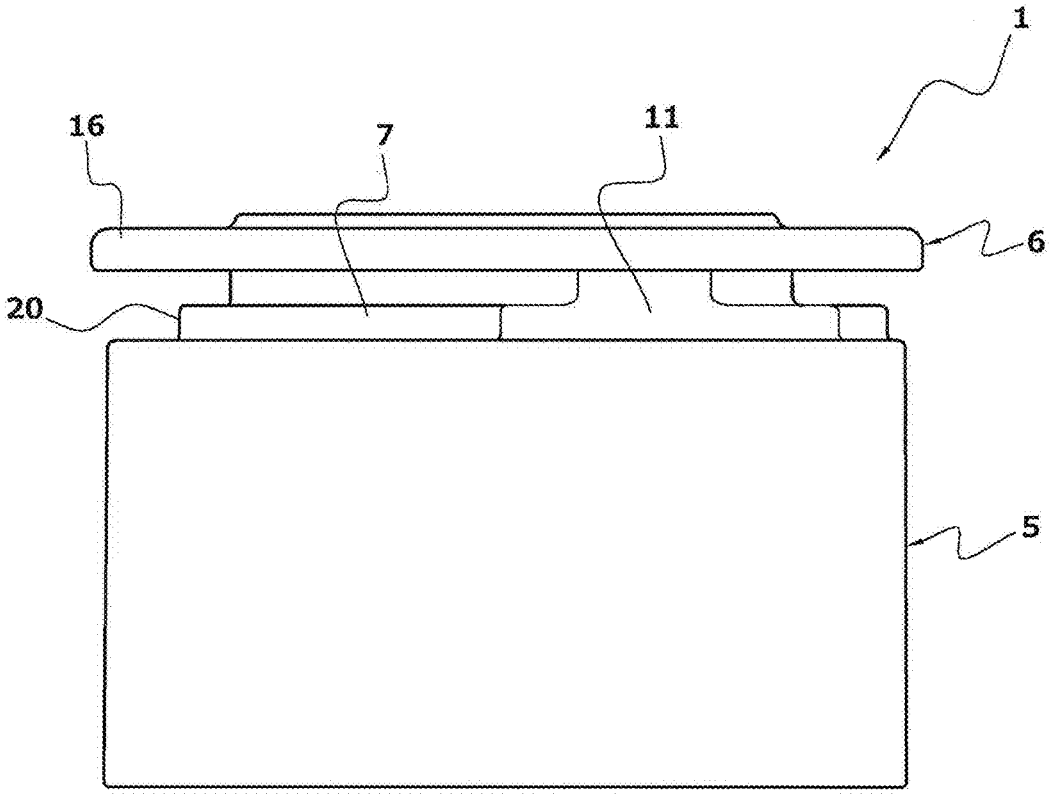
FIG. 8 is an enlarged front view of the cap.

As shown in FIGS. 7 and 8, by providing level difference portions 20 in the radially intermediate position of a top plate 7 of a cap body 5, a larger space can also be formed under the outer periphery of a protective cover 6.

Figure 9:
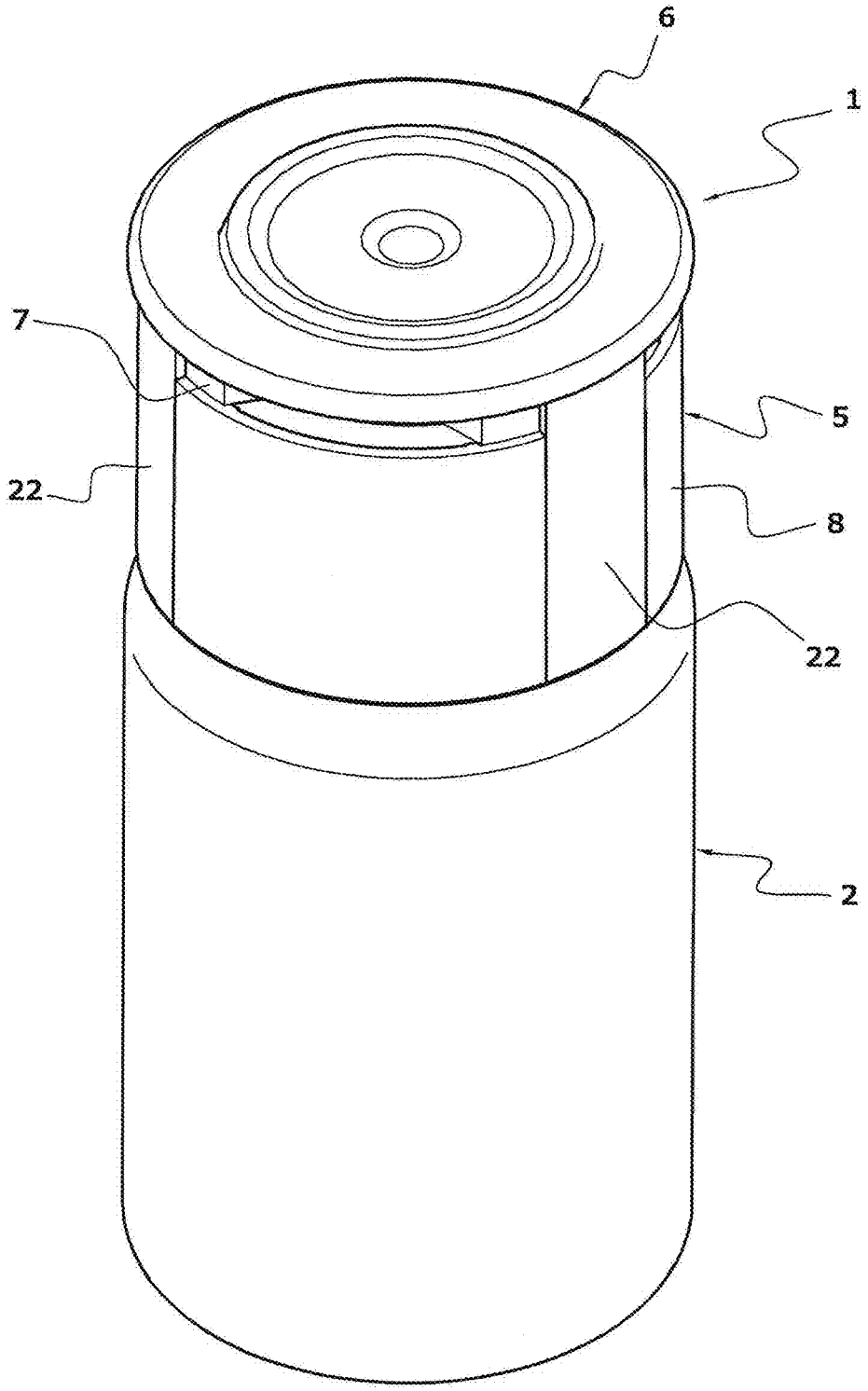
FIG. 9 is a perspective view showing a snap-on vial cap fitted on a vial, according to a fifth embodiment of the present invention.
Figure 10:
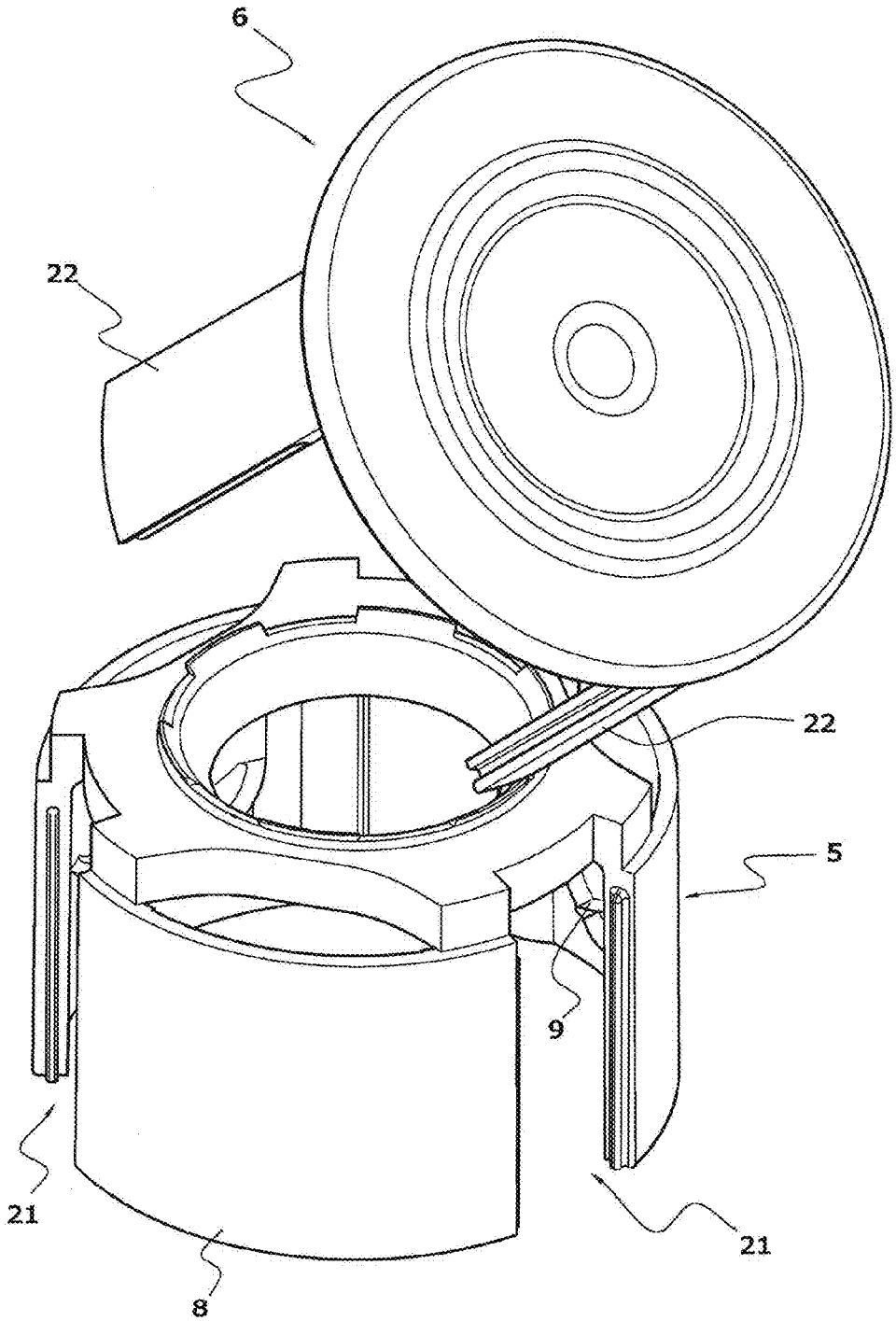
FIG. 10 is a perspective view showing the cap with the protective cover removed.

As shown in FIGS. 9 and 10, slits 21 vertically extended are formed circumferentially at plural places of a cylinder 8 of a cap body 5, while connecting pieces 22 to fill the respective slits 21 can be integrally molded with a protective cover 6. It is preferred that respective end faces of the cylinder 8 and the connecting pieces 22 are concavo-convex fitted, wherein these connecting pieces 22 are formed with the cylinder 8 as a mold face at the time of injection molding of the protective cover 6. Due to the concavo-convex fitting of the cylinder 8 and the connecting pieces 22, and also the adhesive strength between contact faces therebetween, the connecting pieces 22 are prevented from being accidentally separated from the cylinder 8, thereby deformation of the cylinder 8 in such a manner that slits 21 are widened can be prevented. When the protective cover 6 is compulsorily pushed up with a finger, the connecting pieces 22 are separated from the cylinder 8, which allows that cylinder 8 to deform in such a manner that slits are widen, and thus the cap body 5 can be removed from the vial mouth 3. According to this embodiment, separate disposal of the vial 2 and the cap body 5 can be easily conducted. In the illustrated embodiment, three connecting pieces 22 are provided, however, only one piece may be acceptable, or two or four or more pieces may be acceptable. Claw portions may not be provided in the region diametrically opposed to the connecting pieces 22 so that the protective cover can also be easily pushed up from this region.

Figure 11:
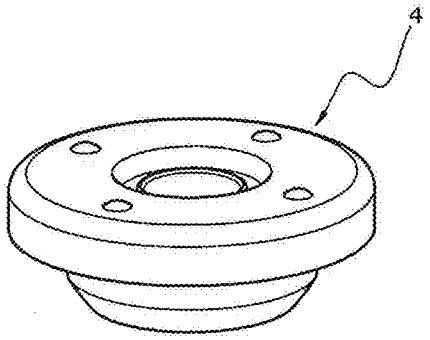
FIG. 11 is a perspective view of a plug.

The above-mentioned plug 4 is preferably made of butyl rubber, which has tackiness on its surface. Therefore, if many plugs 4 are fed into an automatic capping device, the top panels of a pair of plugs 4 may adhere. In order to prevent adhesion of these plugs 4 each other, as shown in FIG. 11, plural small convex portions are formed in the top panel of the plug 4. The plug 4 may be made from thermosetting elastomer, such as vulcanized rubber and thermosetting elastomer, or may be made from thermoplastic elastomer.

Figure 12:
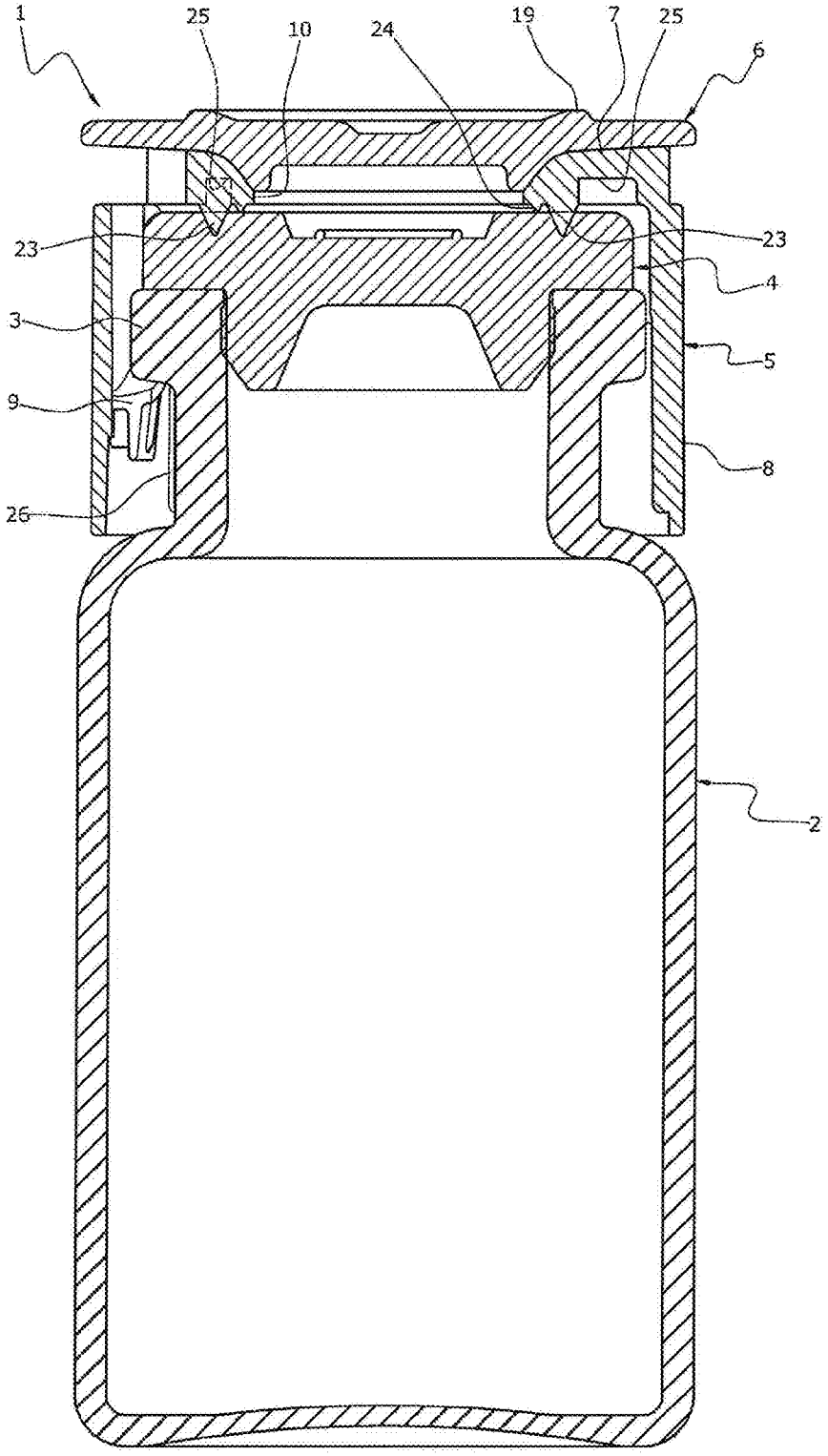
FIG. 12 is a sectional view in general showing a snap-on vial cap fitted on a vial, according to a sixth embodiment of the present invention.
Figure 13:
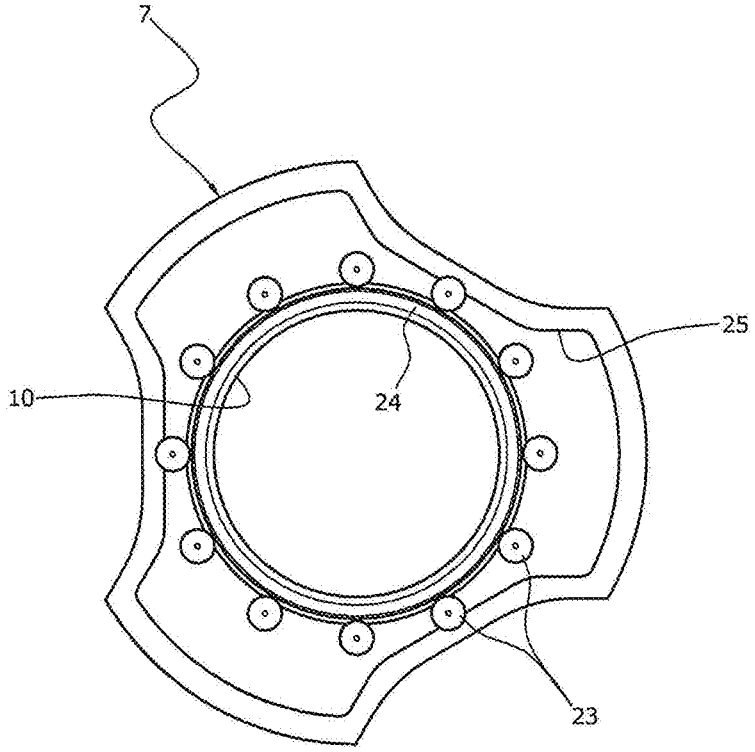
FIG. 13 is a bottom view of a top plate of the cap.
Figure 14:
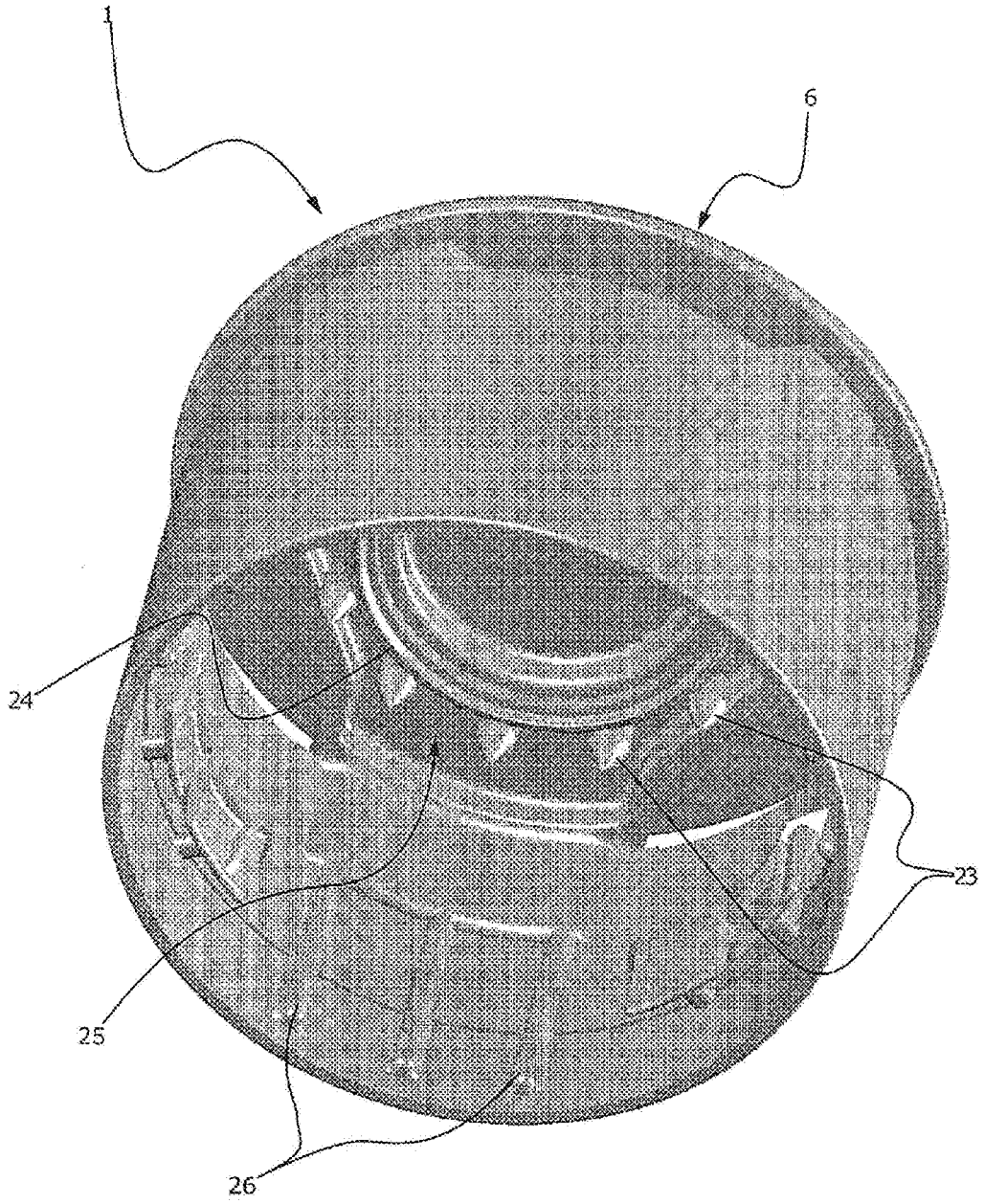
FIG. 14 is a parallel projection seen from the bottom side of the cap.

FIGS. 12 to 14 show another embodiment of the present invention, wherein the same reference numerals are used about the similar structure as in the above first embodiment, detailed description is omitted, and different structure and operation effect are explained. FIG. 13 illustrates only a top plate, in which other component parts of a cap are not shown. FIG. 14 is a three-dimensional parallel projection figure which is rendered by three-dimensional CAD system.

A cap 1 of this embodiment is not provided with a ridge and a claw portion, and a protective cover 6 is attached to a cap body 5 only by the adhesive strength of the contact surfaces therebetween.

On the undersurface of a top plate 7 of the can body 5, plural anti-projections 23, engaged into the upper surface of a plug 4 fitted into a mouth 3 of a vial 2, are projected downward. These plural projections 23 are annularly allocated circumferentially spaced apart at approximately equal intervals in the periphery of a through hole 10. Each projection 23 is positioned so as to vertically oppose to the upper surface of the vial mouth 3. In a suitable embodiment, each projection 23 is tapered into a pin shape. Further, the technical concept of providing "receiving projection" on the undersurface of a top plate is disclosed by Japanese Patent Laid-Open No. 2011-229844. This receiving projection, however, is meant to prevent a flange of a plug from shifting and moving toward a reduced diameter, and it is formed into a continuous annular ring shape over the whole circumference, and thus, such a structure cannot prevent a cap body from rotating.

An annular rib 24 positioned in the periphery of a through hole 10 is projected downward from the undersurface of a top plate 7. The annular rib 24 is installed horizontally so as to pass between the periphery of the through hole 10 and each projection 23. The projection height of this annular rib 24 is lower than that of the projection 23. The annular rib 24 is to be contact with the upper surface of a plug 4 in an airtight state, when a cap 1 is placed over a vial mouth 3. The sectional shape of the annular rib 24 may be any shape, and may be an inverted triangle shape, as shown in the figure, or a square shape, or any other suitable shapes.

A recess 25 dented upward is formed on the undersurface of the top plate 7 in a region between the annular rib 24 and the periphery of the top plate 7, so that the plate thickness of the top plate 7 in the region, where the recess 25 is formed, is thinner than that of the periphery of the top plate 7.

In the internal surface of the cylinder 8 of the cap body 5, there is provided ribs 26 for centering the cylinder 8 on the mouth 3 during the capping process of the cap 1. Under the periphery of the protective cover 6, there is provided space to be hooked by a finger from under in the periphery of the protective cover 6.

According to this embodiment, when the cap 1 is placed over the vial mouth 3 with the plug 4 fitted, plural projections 23 of the cap body 5 are engaged into the plug 4 to prevent the cap 1 from relatively rotating about the vial 2. The annular rib 24 is to be contact with the upper surface of the plug 4 in an airtight state over the whole circumference of the through hole 10, the central part of the upper surface of the plug 4 is isolated from the open air, and thus, can be prevented from being contaminated. Further, a recess 25 is formed over the whole undersurface of the top plate 7 except for the periphery and the annular rib 24, and thus, the top plate 7 is intended to be thinned so that sink marks can be avoided, from being generated on the upper surface of the top plate by resin cooling after injection molding, and also only the annular rib 24 can be brought into contact with the plug 4 locally, which leads to improved airtightness of the contact portion of the annular rib 24 and the plug 4.

The present invention is not limited to the above-mentioned embodiments, and the design can be varied properly. For example, the cap related to the embodiment shown in FIGS. 12 to 14 can be provided with elements for the cap shown in FIGS. 1 to 10, such as a ridge, a claw part, or the like.

REFERENCE SIGNS LIST

1 Snap-on vial cap
2 Vial
3 Vial mouth
4 Vial plug
5 Cap body
6 Protective cover
7 Top plate
8 Cylinder
9 Snap portion(s)
10 Through hole
12 Annular convex portion (ridge)
13 Annular convex portion (claw portion)
14 Concave portion
15 Boss portion
16 Flange
18 Engagement portion
19 Reinforcement rim portion
21 Slit(s)
22 Connecting piece(s)
23 Anti-rotation projection(s)
24 Annular rib
25 Concave portion

The invention claimed is:

1. A vial cap comprising a synthetic resin cap body having an upper surface and a synthetic resin protective cover; wherein the cap body is fitted onto a mouth of a vial and is provided with a through hole vertically penetrated in the central part thereof; and wherein the protective cover is removably attached to the upper surface of the cap body to close the through hole, characterized in that an adhesive strength is generated between mutual contacting surfaces of the cap body and the protective cover by injection-molding either one of the cap body and the protective cover making the contacting surface of the other, preliminarily formed by an injection molding method and inserted in an injection mold for forming the one, serve as a shaping surface for forming the contacting surface of the one, wherein the cap body includes an annular convex portion with a radially concave portion, the convex portion projected upward from the upper surface of the cap body and positioned in the periphery of the through hole, the concave portion formed on an outer circumferential surface or an inner circumferential surface of the convex portion; and wherein the protective cover is provided with an engagement portion to fill the concave portion, and wherein the annular convex portion comprises plural claw parts allocated circumfentially spaced apart; the claw parts each has an upper-limit side inclined radially outward; and the concave portion is formed on the outer circumferential surface of said claw part.

2. The vial cap according to claim 1, wherein the upper surface of the cap body is in surface-contact with the undersurface of the protective cover; and the contact surface of said cap body is positioned in the periphery of the annular convex portion.

3. The vial cap according to claim 1, wherein the annular convex portion is provided with a circumferentially continuous ridge.

4. The vial cap according to claim 1, wherein the concave portion is formed on the outer circumferential surface of the convex portion; the protective cover is provided with a flange extended radially outward from the engagement portion; and space as a fingerplate is formed in at least part of the circumferential direction under the outer periphery of said flange.

5. The vial cap according to claim 1, wherein a reinforcement rim portion positioned above the annular convex portion is provided on the upper surface of the protective cover.

6. A vial cap comprising a synthetic resin cap body having an upper surface and a synthetic resin protective cover; wherein the cap body is fitted onto a mouth of a vial and is provided with a through hole vertically penetrated in the central part thereof; and wherein the protective cover is removably attached to the upper surface of the cap body to close the through hole, characterized in that an adhesive strength is generated between mutual contacting surfaces of the cap body and the protective cover by injection-molding either one of the cap body and the protective cover making the contacting surface of the other, preliminarily formed by an injection molding method, and inserted in an injection mold for forming the one, serve as a shaping surface for forming the contacting surface of the one, wherein the cap body includes an annular convex portion with a radially concave portion, the convex portion projected upward from the upper surface of the cap body and positioned in the periphery of the through hole, the concave portion formed on an outer circumferential surface or an inner circumferential surface of the convex portion; and wherein the protective cover is provided with an engagement portion to fill the concave portion;

wherein the cap body comprises a top plate for pressing down a plug which is fitted into the mouth of the vial, and a cylindrical portion which covers the outer periphery of the mouth of the vial;

the through hole and the annular convex portion are provided on the top plate;

snap portions are provided on the inner circumferential surface of the cylinder to be engaged vertically with the mouth of the vial and a slit extended vertically is formed in at least part of the circumferential direction; and the protective cover further comprises a connecting piece to fill the slit, whereby deformation of the cylinder such that the slit is widened is prevented by the connecting piece, while if the connecting piece is removed from the cylinder, the cylinder deforms to widen the slit, which enables removal of the cap body from the vial mouth.

7. A cap for a vial comprising:

a synthetic resin cap body having a top plate, an upper surface, and a contacting surface, said cap body being adapted to fit onto a mouth of a vial and including a central through hole, said cap body further including an annular convex portion and a radially concave portion wherein the convex portion projects upward from the upper surface of the cap body and is positioned in the periphery of the through hole, and the concave portion is formed on one of an outer circumferential surface or an inner circumferential surface of the convex portion; and a synthetic resin protective cover having a contacting surface and being removably attached to the upper surface of the cap body to close the through hole, said attachment of said protective cover to said cap body being an adhesion between the cap body contacting surface and the protective cover contacting surface formed by injection-molding one of the cap body and the protective cover in an injection mold wherein the contacting surface of the other of the cap body and protective cover defines a shaping surface in the injection mold for forming the contacting surface of the one of the cap body and protective cover, said protective cover including an engagement portion to fill the concave portion;

wherein the annular convex portion comprises plural claw arts allocated circumferentially spaced apart; the claw parts each has an upper-limit side inclined radially outward; and the concave portion is formed on the outer circumferential surface of said claw part.

8. The vial cap according to claim 7, wherein the upper surface of the cap body is in surface-contact with the undersurface of the protective cover; and the contact surface of said cap body is positioned in the periphery of the annular convex portion.

9. The vial cap according to claim 7, wherein the annular convex portion is provided with a circumferentially continuous ridge.

10. The vial cap according to claim 7, wherein the concave portion is formed on the outer circumferential surface of the convex portion; the protective cover is provided with a flange extended radially outward from the engagement portion; and space as a fingerplate is formed in at least part of the circumferential direction under the outer periphery of said flange.

11. The vial cap according to claim 7, wherein a reinforcement rim portion positioned above the annular convex portion is provided on the upper surface of the protective cover.

12. A vial cap comprising:

a synthetic resin cap body having a top plate, an upper surface, and a contacting surface, said cap body being adapted to fit onto a mouth of a vial and including a central through hole, said cap body further including an annular convex portion and a radially concave portion wherein the convex portion projects upward from the upper surface of the cap body and is positioned in the periphery of the through hole, and the concave portion is formed on one of an outer circumferential surface or an inner circumferential surface of the convex portion; and a synthetic resin protective cover having a contacting surface and being removably attached to the upper surface of the cap body to close the through hole, said attachment of said protective cover to said cap body being an adhesion between the cap body contacting surface and the protective cover contacting surface formed by injection-molding one of the cap body and the protective cover in an injection mold wherein the contacting surface of the other of the cap body and protective cover defines a shaping surface in the injection mold for forming the contacting surface of the one of the cap body and protective cover, said protective cover including an engagement portion to fill the concave portion;

wherein the cap body comprises a top plate for pressing down a plug which is fitted into the mouth of the vial, and a cylindrical portion which covers the outer periphery of the mouth of the vial;

the through hole and the annular convex portion are provided on the top plate;

snap portions are provided on the inner circumferential surface of the cylinder to be engaged vertically with the mouth of the vial and a slit extended vertically is formed in at least part of the circumferential direction; and the protective cover further comprises a connecting piece to fill the slit, whereby deformation of the cylinder such that the slit is widened is prevented by the connecting piece, while if the connecting piece is removed from the cylinder, the cylinder deforms to widen the slit, which enables removal of the cap body from the vial mouth.

* * * * *